United States Patent [19]

Rodnunsky

[11] 4,120,522

[45] Oct. 17, 1978

[54] MACRAME-FORMING DEVICE

[76] Inventor: Patricia A. Rodnunsky, 17810 Simonds St., Granada Hills, Calif. 91344

[21] Appl. No.: 784,057

[22] Filed: Apr. 4, 1977

[51] Int. Cl.[2] ..... D04G 5/00

[52] U.S. Cl. ..... 289/18; 211/189; 248/122

[58] Field of Search ..... 289/1.5, 18; 28/15, 28/149; 211/189, 30; 248/122, 534, 511

[56] References Cited

U.S. PATENT DOCUMENTS

| | | | |
|---|---|---|---|
| 1,631,227 | 6/1927 | See | 248/511 |
| 1,747,951 | 2/1930 | Reichert | 211/30 |
| 4,003,592 | 1/1977 | Schreves | 289/18 |
| 4,029,347 | 6/1977 | Garcia | 289/18 |
| 4,032,179 | 6/1977 | Goss | 289/18 |

*Primary Examiner*—Louis K. Rimrodt
*Attorney, Agent, or Firm*—John J. Posta, Jr.

[57] ABSTRACT

An improved device for forming macrame includes an elongated extensible center pole held in an upright position by a preferably weighted support base, and bearing a plurality of spaced, releasably secured, adjustable frame support members, each in the form of a central collar with radiating removable spokes. A top macrame-supporting hook or bracket bearing spaced hooks is secured to the upper end of the pole.

The device enables one to readily perform the method of the present invention and thus quickly and easily make a hanging macrame item or the like. In carrying out the method, macrame-forming material is secured to the top hook bracket, or hooks and passed down over open frames which may be symmetrically supported on the device specifically around the center pole on the support members. Macrame is then progressively formed, preferably from adjacent the top of the pole downwardly, the spacing of the frames and support members enabling one to pull the macrame material taut thereover before and during macrame formation. The pole can be periodically adjusted in height in order to keep the work in full view as it progresses. When the macrame is fully formed, it is separated from the device, removing the frames or leaving them in place, as desired.

12 Claims, 4 Drawing Figures

MACRAME-FORMING DEVICE

BACKGROUND OF THE INVENTION

1. Field of the Invention

The present invention generally relates to handicraft devices and methods and more particularly to an improved device and method for making macrame.

2. Prior Art

Macrame by definition is a coarse lace or fringe made by knotting lengths of cord or the like into a geometrical pattern. When it is desired to make a three dimensional hanging macrame, such as is utilized to cover and sometimes support hanging plants, pots, lamps and the like, many difficulties can be encountered. In this regard, the design being formed may be very difficult to form symmetrically and evenly. Often, the end product is undesirably unbalanced, asymmetrical and unappealing. Moreover, the design may appear to be quite different when the finished macrame is hung, as opposed to when it is being formed on a flat surface or the like. Frequently, macrame is formed while the cords thereof are not in full tension. Subsequently, when tension is applied to the finished macrame, as during hanging, the knots initially formed may slip and/or be found to be loose or out of line and thus the design and shape of the product may suffer.

Accordingly, there is a need for a simple, inexpensive, efficient device and method for use in making macrame, including that of the hanging type, which device and method will overcome the foregoing difficulties.

SUMMARY OF THE INVENTION

The foregoing needs have now been satisfied by the improved device and method for making macrame. Thus, macrame is easily and rapidly formed on the present device in any desired shape and pattern, according to the present method, without knot slippage, asymmetry and other common problems. The device is inexpensive, simple to make and use, durable and efficient. It enables the macrame making work to be carried out at the most desirable work level. Unfinished work can be left on the device, and finished at a later date, a great convenience. The device includes, substantially as set forth in the Abstract above, an elongated extensible upright center pole on a removable support base. The pole bears a plurality of spaced releasably secured adjustable frame support members in the form of central collars with removable radiating spokes marked with indicia to help center open guide frames thereon. The upper end of the pole supports a top hook or bracket bearing spaced hooks from which to hang the macrame-forming material. The bracket may have adjustable arms to aid in positioning the hooks and material, such material is caused to drape down over the frames and is then pulled taut and progressively knotted together from the top down or, if desired, in any other suitable progressive sequence. The pole can be periodically adjusted in height to bring the work being performed close at hand for best results. When the macrame is finished, the device is removed, with or without the frames leaving the precisely executed finished macrame product. The frames in certain instances become part of the finished macrame product. The improved device of the present invention is easily assembled and just as easily disassembled and stored away. Further features are set forth in the following detailed description and accompanying drawings.

DRAWINGS

DETAILED DESCRIPTION

FIG. 1

Figure 1:
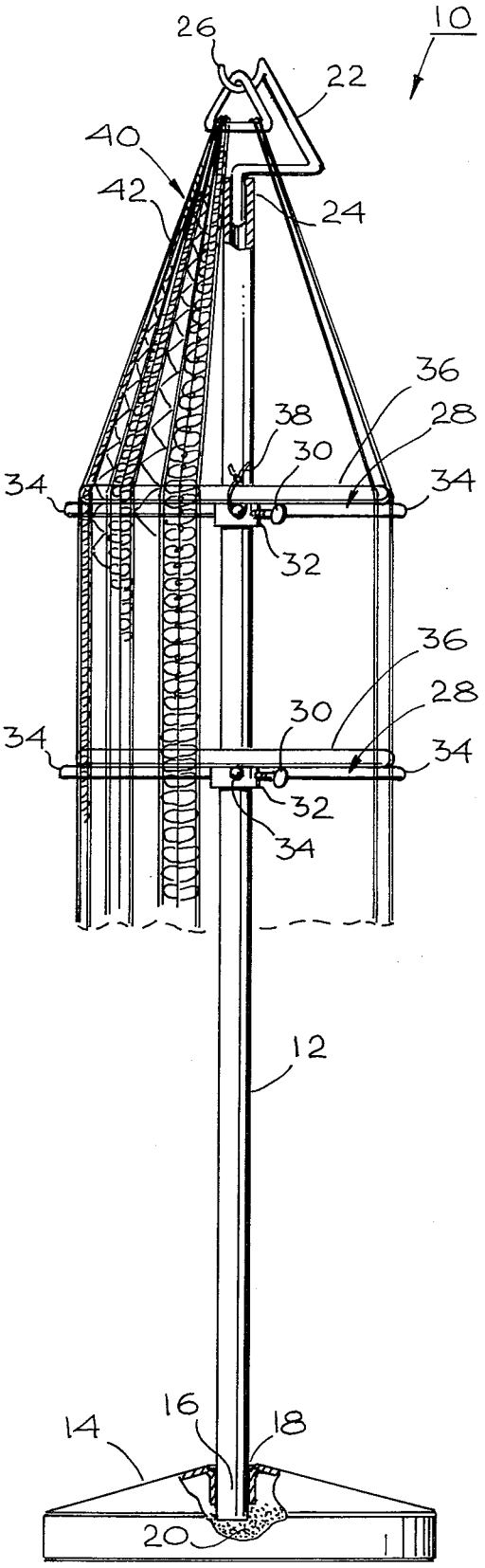
FIG. 1 is a schematic front elevation, partly broken away, of a first preferred embodiment of the improved device of the present invention, with macrame being formed thereon.

Now referring more particularly to FIG. 1 of the drawings, a first preferred embodiment of the improved device of the present invention is schematically depicted therein. Thus, device 10 is shown in front elevation and comprises an elongated hollow tubular center pole of metal such as aluminum or steel, of plastic, or wood or the like. Pole 12 is held in an upright vertical position by a horizontally extending support base 14, the lower end 16 of pole 12 being received within an opening 18 in the top of base 14. Base 14 may be made of metal, wood, plastic or the like, is hollow and includes sufficient ballast 20 such as sand therein to render device 10 stable.

Device 10 also includes a macrame material-holding bracket 22 releasably secured to the upper end 24 of pole 12. Bracket 22 is of metal, wood, plastic or the like and includes a hook 26 centered above end 24. A pair of spaced frame support members 28, also of metal, wood, plastic or the like are releasably secured, as by set screws 30, to desired locations, as shown in FIG. 1, around pole 12 between its upper and lower ends. Each member 28 comprises a central collar 32 and a plurality (such as four) of spaced removable spokes 24 symmetrically radiating outwardly therefrom. Members 28 are used to support open work guide frames 36 centered thereon and releasably secured thereto, as by tie cords 38 or the like. Frames 36 may be of metal, wood, plastic or the like and can be provided in any desired shape, size and configuration, as the design of the macrame demands.

In carrying out the present improved method of making macrame, the material 40 in the form of elongated cords 42, from which the macrame is made is draped over hook 26 and passed down over frames 36 and members 28, as shown in FIG. 1. If desired, it can be stretched taut and temporarily or permanently anchored to frames 36. The knotting together of cords 42 is then carried out progressively from the top down or in any other suitable sequence until completed.

When the macrame is finished, spokes 34 can be removed from collars 32, pole 12 can then be removed from opening 18 and then collars 32, ties 38 and frames 36 can be removed therefrom. However, if frames 36 are incorporated into the finished macrame construction, ties 38 are first removed and then spokes 34, whereupon the macrame and frames 36 are lifted off of pole 12 along with bracket 22. The finished product is then detached from bracket 22. Accordingly, the present method is simple, direct and effective in producing a superior, uniform macrame product having improved uniformity and symmetry.

Figure 2:
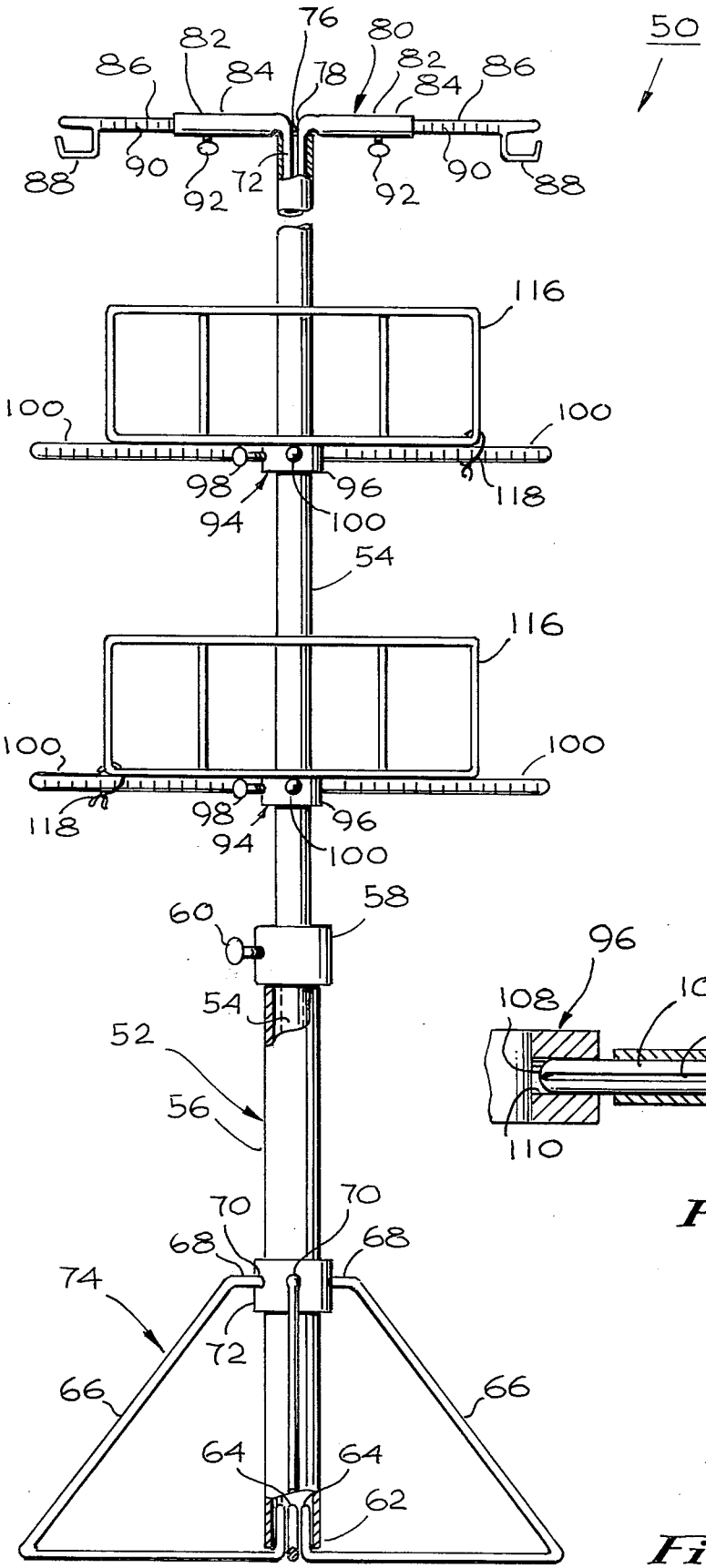
FIG. 2 is a schematic front elevation, partly broken away, of a second preferred embodiment of the improved device of the present invention.
Figure 3:
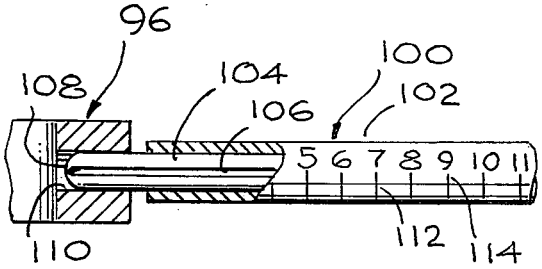
FIG. 3 is an enlarged schematic fragmentary side elevation of a spoke and collar of the device of FIG. 2; and, FIG. 4 is a schematic perspective view, partly broken away, of a third preferred embodiment of the improved device of the present invention.

FIGS. 2 and 3

A second preferred embodiment of the improved device of the present invention is schematically illustrated in FIG. 2. Thus, as shown therein in front elevation, a device 50 is provided which comprises an elongated central pole 52 comprising an upper hollow tubular member 54 slideably disposed within a lower hollow tubular member 56, a collar 58 with set screw 60 being disposed at their juncture to releasably hold member 54 relative to member 56.

The lower end 62 of member 56 is open and releasably receives the upturned segments 64 at one end of wire legs 66 while segments 68 at the opposite ends of legs 66 are releasably received in openings 70 in a collar 72 slideably disposed around member 56. Legs 66 and collar 72 form a sturdy support base 74 for holding pole 52 vertically upright.

The open upper end 76 of pole 52 releasably receives a vertical depending segment 78 of a bracket 80. Bracket 80 includes a pair of diverging horizontally disposed arms 82 comprising hollow tubes 84 slideably receiving laterally disposed members 86 bearing hooks 88 at their distal ends. Members 86 also bear indicia 90 on their outer surfaces to enable them to be releasably secured, as by set screws 92, in desired locations relative to pole 52.

It will be understood that a hook device, vertically aligned with the center of pole such as that shown in FIG. 1 can, if desired, be substituted for bracket 80.

Disposed on pole 52 between bracket 80 and support base 74 are a pair of spaced horizontally extending frame support members 94, each comprising a central collar 96 releasably adjustably secured, as by a set screw 98, to pole 52 and having disposed therein a plurality of, for example four, spokes 100 radiating symmetrically outwardly therefrom.

Each spoke 100 comprises, as shown particularly in FIG. 3, a hollow tube 102 slideably disposed over a hollow tubular guide pin 104 of spring steel or the like bearing a slit 106 extending longitudinally through the wall thereof so that the diameter of pin 104 can be temporarily decreased, enabling the reduced end 108 of pin 104 to be forced into a suitably shaped hole 110 in collar 96. With this arrangement, tubes 102 and pins 104 can easily be removed from and releasably secured to collar 96, as desired. It will also be noted that tubes 102 bear indicia 112 in the form of a numbered scale 114 to permit frames 116 to be properly and easily centered around pole 52, as shown in FIG. 2, on members 94. Frames 116 are releasably secured to members 94, as by tie cords 118 or the like. The components of device 50 may be fabricated of any suitable materials, such as wood, metal, plastic or any combination thereof.

When devices 10 and 50 are compared, it will be noted that pole 52 is adjustable, whereas pole 12 is not. This adjustability is highly desired because it enables one who is making the macrame to constantly keep the area being worked on at the proper working height. Obviously, members 94 can be spaced apart, as desired, and the shape, size and configuration of frames 116 can be varied, depending on the particular macrame design, the size of the construction, etc. Members 28 of device 10 are similarly adjustable. Support base 74, while light of weight, is simple, inexpensive, sturdy, and easily assembled and disassembled, as are the other components of device 50. Device 50 can be readily used in carrying out the present method, in the manner as previously described in connection with device 10.

FIG. 4

Figure 4:
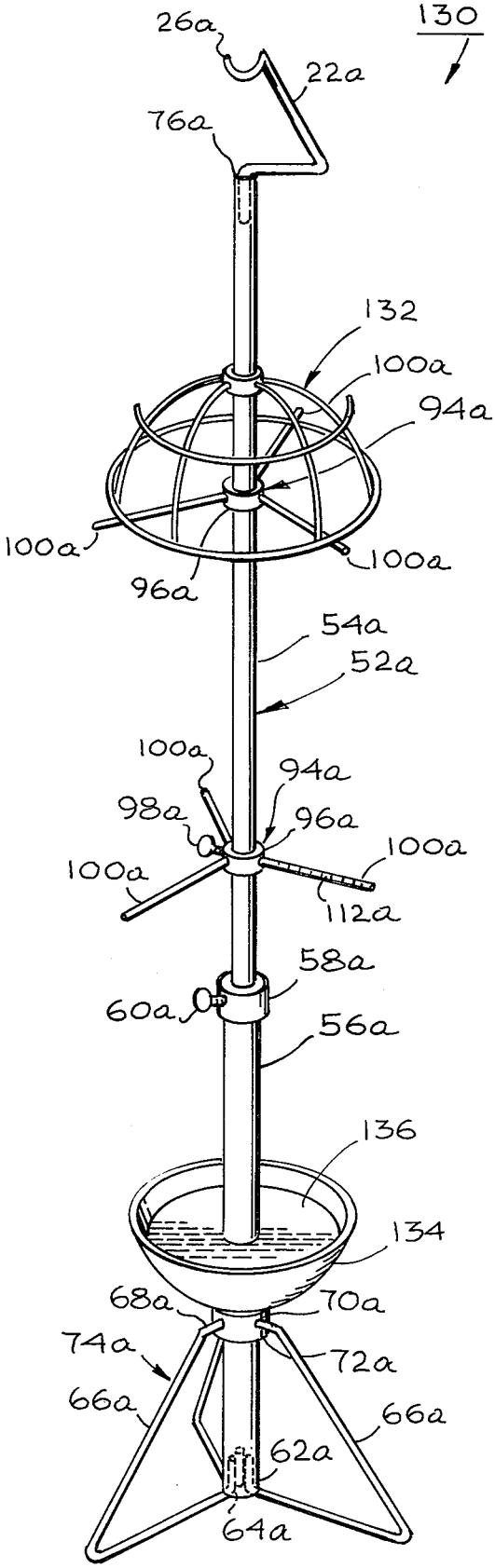

A third preferred embodiment of the device of the present invention is schematically depicted in FIG. 4 of the drawings. Thus, device 130 is shown in perspective view. Device 130 bears many features essentially the same as those of devices 10 and 50. Components similar to those previously described bear the same numerals but are followed by the letter "*a*". Thus, device 130 includes pole **52*a*, comprised of sliding members 54*a* and 56*a* secured by collar 58*a* and set screw 60*a*, the lower end 62*a* of member 56*a* receiving segments 64*a* of three legs 66*a*, the upper segments 68*a* of which are received in openings 70*a* in a collar 72*a*. Collar 72*a* and legs 66*a* form support base 74*a***.

The upper end **76*a* of pole 52*a* releasably receives a bracket 22*a*, its upper end 24*a* ending in a hook 26*a* aligned with the longitudinal axis of pole 52*a*. A pair of support members 94*a* disposed on pole 52*a* each comprise a collar 96*a* with set screw 98*a*, and three radiating spokes 100*a* removably secured therein. Each spoke 100*a* includes indicia 112*a* in the form of a scale (not shown) on the outer surfaces thereof for proper alignment of a frame such as frame 132 on spokes 100*a***.

Device 130 also includes ballast means in the form of an open topped pot 134 sealingly secured on the top of collar **72*a* and capable of receiving ballast material such as water 136, as shown in FIG. 4. Device 130 thus has the advantages of devices 10 and 50** and functions similarly thereto. It can be successfully employed in the present method of making macrame as previously described. It is simple, inexpensive, compact, durable and effective.

Various modifications, changes, alterations and additions can be made in the present improved device and its components, and the present improved method, its steps and parameters. All such modifications, changes, alterations and additions as are within the scope of the appended claims form part of the present invention.

I claim:

1. An improved macrame-forming device, said device comprising, in combination:

a. an elongated center pole;

b. a support base secured to and maintaining said pole in an upright generally vertical position;

c. a plurality of frame support members releasably secured to said pole at spaced locations along its length and extending outwardly therefrom;

d. A plurality of frames supported by said frame support members; and e. a macrame material-holding bracket secured to said pole above said support members and adjacent the upper end of said pole.

2. The improved device of claim 1 wherein said frame support members extend symmetrically radially outwardly from said center pole.

3. The improved device of claim 2 wherein each of said frame support members comprises a collar releasably secured to said center pole and a plurality of spokes radiating from said collar, each spoke comprising a hollow outer tube slideably received over a hollow tubular support pin bearing a slit along the length thereof, said pin being releasably force fitted in said collar.

4. The improved device of claim 1 wherein said center pole is hollow, tubular, extensible and removable from said support base.

5. The improved device of claim 4 wherein said support base includes ballast means.

6. The improved device of claim 5 wherein said ballast means includes a liquid-retaining open topped receptacle.

7. The improved device of claim 4 wherein said support base comprises a collar secured to said pole and spaced wire support legs releasably secured to said collar.

8. The improved device of claim 4 wherein said hollow outer tubes of said spokes bear indicia thereon for aligning frames thereon.

9. The improved device of claim 1 wherein said center pole is hollow and tubular and wherein said macrame holding bracket is releasably secured to the open upper end of said center pole.

10. The improved device of claim 9 wherein said macrame holding bracket comprises a hook.

11. The improved device of claim 9 wherein said macrame holding bracket includes a pair of extensible diverging arms, each arm bearing at least one hook.

12. The improved device of claim 11 wherein said arms bear indicia thereon for aligning said hooks.

* * * * *